US007207203B2

(12) United States Patent
Corn

(10) Patent No.: US 7,207,203 B2
(45) Date of Patent: Apr. 24, 2007

(54) METHODS AND APPARATUS FOR FORMING A WORKPIECE

(75) Inventor: Randall Stephen Corn, Travelers Rest, SC (US)

(73) Assignee: General Electric Company, Schenectady, NY (US)

( * ) Notice: Subject to any disclaimer, the term of this patent is extended or adjusted under 35 U.S.C. 154(b) by 51 days.

(21) Appl. No.: 10/831,571

(22) Filed: Apr. 23, 2004

(65) Prior Publication Data

US 2005/0235724 A1 Oct. 27, 2005

(51) Int. Cl.
*B21D 41/02* (2006.01)
*B21D 53/92* (2006.01)

(52) U.S. Cl. ..... 72/316; 72/402

(58) Field of Classification Search ..... 72/318, 72/316, 311, 402, 399, 393, 353.4, 353.6, 72/370.08

See application file for complete search history.

(56) References Cited

U.S. PATENT DOCUMENTS 1,706,910 A * 3/1929 Wright et al. ..... 493/109
2,438,999 A * 4/1948 Hartley et al. ..... 72/20.3
2,691,906 A * 10/1954 Finch ..... 72/353.4
2,937,687 A * 5/1960 Gould ..... 72/393
3,266,451 A * 8/1966 Kraus ..... 72/84
3,357,229 A * 12/1967 Luedi ..... 72/393
3,411,338 A * 11/1968 Carlin ..... 72/293
3,580,020 A * 5/1971 Bindernagel et al. ..... 72/58
4,273,738 A 6/1981 Spengler
4,380,165 A * 4/1983 Post ..... 72/353.6
4,821,391 A * 4/1989 Paterick ..... 29/253
5,491,994 A * 2/1996 Baldyga ..... 72/20.1
5,765,430 A * 6/1998 Iihara et al. ..... 72/353.4
5,950,472 A * 9/1999 Grotnes et al. ..... 72/105
6,378,184 B1 4/2002 Bota
6,584,824 B1 * 7/2003 Peterson et al. ..... 72/393
6,708,548 B2 * 3/2004 Ehrke et al. ..... 72/312
2004/0237617 A1 * 12/2004 Sperrer ..... 72/31.1

* cited by examiner

*Primary Examiner*—Daniel C. Crane
(74) *Attorney, Agent, or Firm*—Armstrong Teasdale LLP

(57) ABSTRACT

A method of forming a workpiece using an apparatus is provided. The apparatus includes a first stage including a die fixture, a die actuator coupled to the die fixture, and a holding member configured to cooperate with the die fixture to hold the workpiece. The method includes holding the workpiece to the first stage die fixture using the first stage holding member, and conforming the workpiece to a first predetermined dimension using the first stage die fixture.

28 Claims, 6 Drawing Sheets

METHODS AND APPARATUS FOR FORMING A WORKPIECE

BACKGROUND OF THE INVENTION

This invention relates generally to manufacturing techniques, and more specifically to methods and apparatus for securing and forming components for manufacture.

Accurate manufacturing of a component may be a significant factor in determining a manufacturing time of the component. Specifically, when the component is a gas turbine engine transition piece, accurate manufacturing and/or reforming of the transition piece may be a significant factor affecting an overall cost of fabrication or maintenance of the gas turbine engine, as well as subsequent modifications, repairs, and inspections of the transition piece. For example, at least some known gas turbine engine transition pieces have a complex geometrical shape at an aft-end of the transition piece which enables the aft-end to mate with a component called a picture frame.

During initial manufacture, transition piece blanks fabricated to near-specification dimensions are supplied to a finishing process that shapes the transition piece to the close tolerances required by the manufacturing process quality control. The transition piece may also be a component that has been used in an operating gas turbine and returned to a shop to correct a deformation condition known as thermal creep. More specifically, during operation at elevated temperatures, the transition piece may deform from the engineering design specification dimensions. Maintenance procedures may then be required to return the transition piece dimensions to design specification dimensions.

At least some known manufacturing processes used with transition pieces may be substantially manual, such as, through the use of a ball peen hammer, manual pump hydraulic jack, and acetylene torch to physically form the aft-end of the transition piece. However, such methods may create irregularities in the transition piece shape, specifically in the corners, leading to mismatches in the flow path from the transition piece body to the picture frame. The hydraulic jacking method creates irregularities in the inner and outer rails due to the point loading that occurs when using manual hydraulic jacks. Often, the mismatched components do not meet specific engineering specifications, resulting in a defective part. The ball peen hammer may also create a thinning of the parent metal in the corners. Tools, such as, an ID profile gage, have been developed to improve dimensional accuracy and assist in the manufacturing process. The ID profile gage may be inserted into the mouth of the aft-end of the transition piece and the transition piece body formed with a hammer or hydraulic jack to match the contour of the gage. However, such tools generally do not improve the throughput of transition pieces through the process, and may cause flatness defects due to additional machining that may be necessary after using such techniques.

BRIEF DESCRIPTION OF THE INVENTION

In one aspect, a method of forming a workpiece using an apparatus is provided. The apparatus includes a first stage including a die fixture, a die actuator coupled to the die fixture, and a holding member configured to cooperate with the die fixture to hold the workpiece. The method includes holding the workpiece to the first stage die fixture using the first stage holding member, and conforming the workpiece to a first predetermined dimension using the first stage die fixture.

In another aspect, an apparatus for forming a workpiece is provided. The apparatus includes a die fixture, a die actuator coupled to the die fixture, and a holding member configured to cooperate with the die fixture to hold the workpiece.

DETAILED DESCRIPTION OF THE INVENTION

As used herein, the terms "manufacture" and "manufacturing" may include any manufacturing process. For example, manufacturing processes may include grinding, finishing, polishing, cutting, machining, inspecting, and/or casting. The above examples are intended as exemplary only, and thus are not intended to limit in any way the definition and/or meaning of the terms "manufacture" and "manufacturing". In addition, as used herein the term "workpiece" may include any object to which a manufacturing process is applied. Furthermore, although the invention is described herein in association with a gas turbine engine, and more specifically for use with a transition piece for a gas turbine engine, it should be understood that the present invention may be applicable to any component and/or any manufacturing process. Accordingly, practice of the present invention is not limited to the manufacture of turbine components or other components of gas turbine engines.

Figure 1:
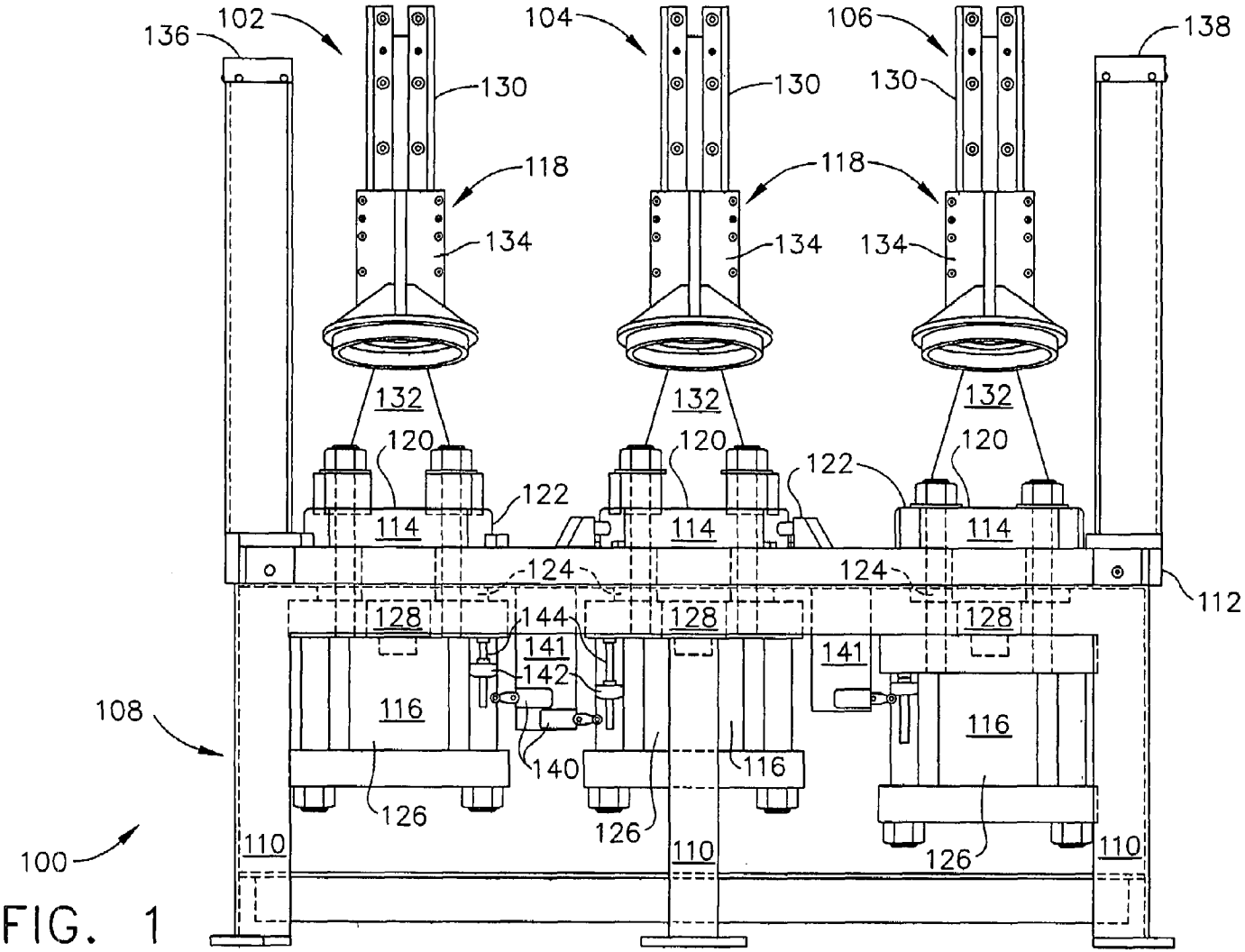
FIG. 1 is a front elevation view of an apparatus that may be used to form a workpiece.

FIG. 1 is a front elevation view of an apparatus 100 that may be used to form a workpiece (not shown). In the exemplary embodiment, apparatus 100 includes a first stage 102, a second stage 104, and a third stage 106. In other embodiments, more or less stages may be used. Each stage may be used to conform the workpiece to a different predetermined dimensional specification relative to each other stage. The dimensional specification may reside, for example, on an engineering drawing of the workpiece, may be determined in response to a request for repair or upgrade of the workpiece. Each stage may be used sequentially to conform the workpiece to predetermined dimensions iteratively, or may be used independently from the other stages to conform the workpiece to a single predetermined dimensional specification. Apparatus 100 may include a stand 108 that includes a plurality of legs 110 coupled to a base 112. In the exemplary embodiment, each stage includes a die fixture 114, a die actuator 116 coupled to die fixture 114, and a holding member 118 coupled to base 112 and configured to operatively hold the workpiece (not shown in FIG. 1).

Die Fixture 114 includes an expander centerpiece 120 that engages an expander wedge 122 that facilitates translating the motion of expander centerpiece 120 to a force imparted to the workpiece to conform the workpiece to a predetermined dimensional specification. Expander centerpiece 120 may be further coupled to a top bracket 124 of die actuator 116. In the exemplary embodiment, die actuator 116 is a ram that includes a hydraulic cylinder 126 and a hydraulic piston (not shown) slidably engaged with hydraulic cylinder 126. The hydraulic piston includes a shaft 128 that extends away from hydraulic cylinder 126 and is configured to couple to top bracket 124, such that as die actuator 116 is operated, shaft 128 extends from and retracts into hydraulic cylinder 126, to impart a motive force to expander centerpiece 120 through top bracket 124.

Holding member 118 includes a vertical slide 130 that is coupled to base 112 through a base end 132, such that vertical slide extends away from base 112. A top holder 134 is slidably coupled to vertical slide 130 through a slide clamp (not shown in FIG. 1).

Stand 108 provides support for stages 102, 104, and 106 and facilitates maintaining die fixture 114, die actuator 116, and holding member 118 substantially aligned with respect to each other. In the exemplary embodiment, apparatus 100 includes a personnel safety interlock, such as, but not limited to a light curtain system that includes a mirror 136 and a transceiver unit 138. In an alternative embodiment, the light curtain system includes a transmitter and a receiver. In the exemplary embodiment, the extent of travel of die actuator is controlled by travel limit switch 140, which is fixedly coupled to stand 108 through for example, a switch mounting plate 141. A selectably variable limit switch trip 142 may include, for example, a threaded rod 144 coupled to top bracket 124, such that limit switch trip 142 moves in proportion to shaft 128. In the exemplary embodiment, limit switch trip 142 may be variably set by threading the limit switch trip axially along threaded rod 144. Controlling the movement of die actuator 116 controls the movement of die fixture 114, such that at least one of the predetermined dimensional specifications may be controlled by the setting of limit switch trip 142. In an alternative embodiment, a limit switch trip may be fixedly coupled to stand 108 and travel limit switch may be coupled to shaft 124 through a travel limit switch mount.

Figure 2:
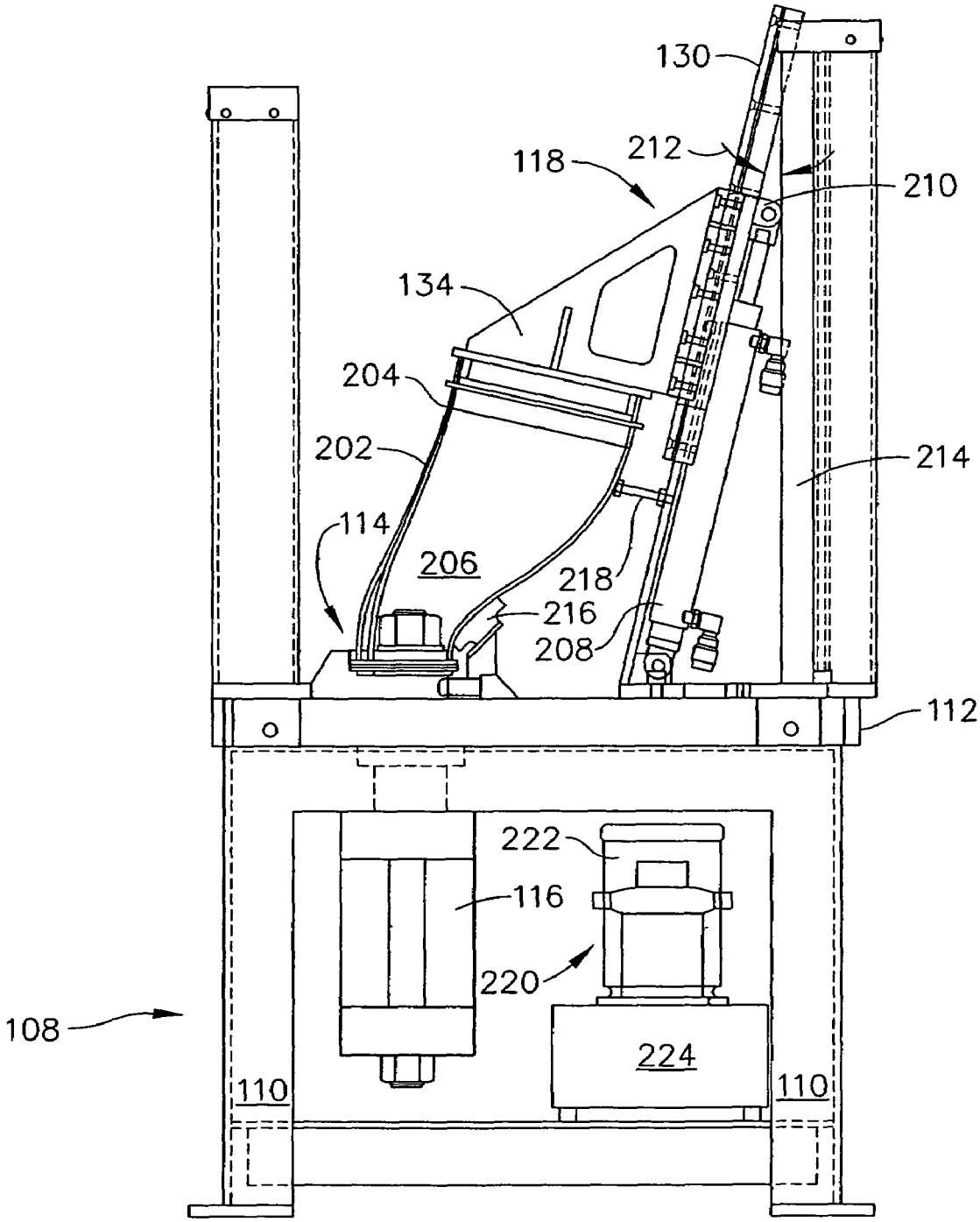
FIG. 2 is a side elevation view of the apparatus shown in FIG. 1.

FIG. 2 is a side elevation view of apparatus 100 (shown in FIG. 1). Elements of apparatus 100 shown in FIG. 2 that are identical to elements of apparatus 100 shown in FIG. 1 are referenced in FIG. 2 using the same reference numerals used in FIG. 1. Accordingly, apparatus 100 includes stand 108 including legs 110 and base 112. Stand 108 provides support for die fixture 114, die actuator 116, and holding member 118. A workpiece 202 is illustrated in FIG. 2 in a "held" position wherein top holder 134 is engaged to a first end 204 of workpiece 202, and die fixture 114 is engaged to a second end 206 of workpiece 202. Workpiece 202 may be a raw workpiece being formed from a fabricated blank, or may be a partially assembled workpiece that includes one or more subparts. Alternatively, workpiece 202 may be a workpiece returned from operation for maintenance to restore the workpiece to predetermined dimensional specifications. Holding member 118 includes an actuator 208 that supplies motive power and a holding force to top holder 134 through a slide clamp 210 that is configured to slide axially along vertical slide 130. In the exemplary embodiment, vertical slide 130 is illustrated at a predetermined fixed angle 212 with respect to a gusset 214. In an alternative embodiment, angle 212 may be selectively variable. In a further embodiment, vertical slide 130 is positioned normal to base 112, such that gusset 214 is not required. In the exemplary embodiment, actuator 208 is a doubling acting hydraulic cylinder. In an alternative embodiment, actuator may be another actuator, such as, but not limited to a lead screw and drive assembly. Apparatus 100 may include auxiliary positioning devices, such as, a shoe 216 and/or a bolt 218. Other positioning devices may be used to facilitate positioning workpiece 202 proximate die fixture 114 and top holder 134.

A hydraulic power unit 220 supplies hydraulic fluid under pressure to die fixture actuator 116, holding member actuator 208, and other hydraulically powered members (not shown), such as a workpiece lifting device and/or manipulator. In the exemplary embodiment, hydraulic power unit 220 includes an electric motor 222 coupled to a hydraulic pump (not shown) submerged in a hydraulic reservoir 224.

Figure 3:
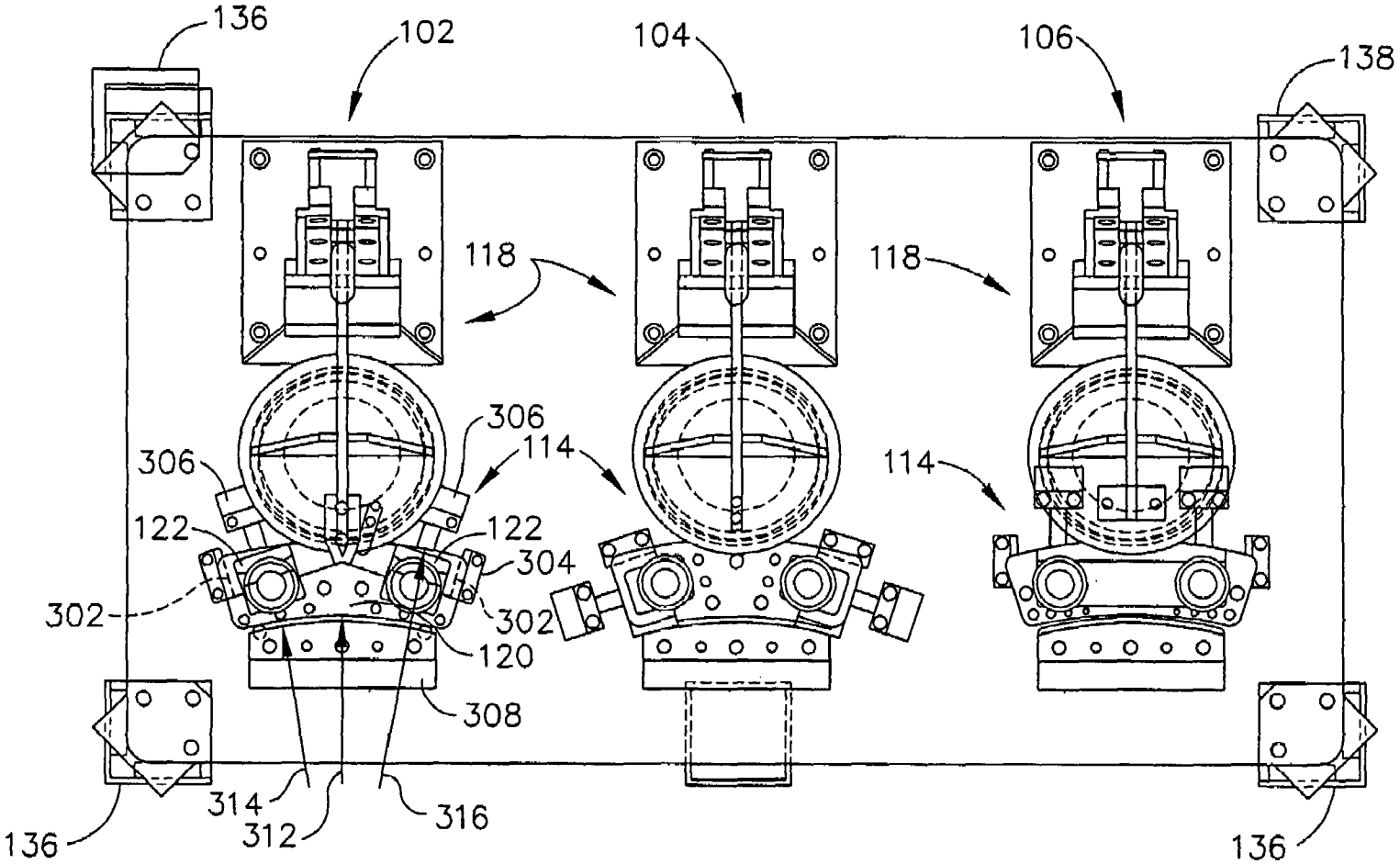
FIG. 3 illustrates a plan view of the apparatus shown in FIGS. 1 and 2.

FIG. 3 illustrates a plan view of apparatus 100 (shown in FIGS. 1 and 2). Elements of apparatus 100 shown in FIG. 3 that are identical to elements of apparatus 100 shown in FIGS. 1 and 2 are referenced in FIG. 3 using the same reference numerals used in FIGS. 1 and 2. Accordingly, apparatus includes first stage 102, second stage 104, and third stage 106. Base 112 supports die fixture 114 and holding member 118 for each stage 102, 104, and 106. Each die fixture includes a plurality of die members, such as expander centerpiece 122, an expander wedge 122, an expander end 302, a stripper 304, a spring return 306, and an expander bottom 308. Each of the die members cooperate to engage workpiece second end 206 in the "held" position and to conform the dimensions of workpiece second end 206 to a predetermined dimensional specification. To facilitate conforming different workpieces 202 with different predetermined dimensional specifications, various die members may be replaceable based on the dimensional specification required for a respective workpiece. For example, expander end 302 may have a first peripheral radius 310 for a first workpiece 202. If a second workpiece (not shown) needed to be formed to a different dimensional specification than the dimensional specification for the first workpiece 202, a replacement expander end (not shown) with a different dimensional specification than expander end 302 would be installed to facilitate conforming the second workpiece to its respective dimensional specification. Similar to expander end 302, an expander centerpiece radius 312, and an expander bottom radius 314 may be modified by replacing the respective die member with a replacement that has a different radius than expander centerpiece 122 and/or expander bottom 308. Furthermore each stage may be configured to conform different workpieces to respective dimensional specifications or may be configured to conform different dimensions of a single workpiece to respective dimensional specifications. For example, in the exemplary embodiment, first stage 102 is configured to conform workpiece 202 to a dimensional specification in a first direction, second stage 104 is configured to conform workpiece 202 to a dimensional specification in a second direction, and third stage 106 is configured to conform workpiece 202 in a third direction. In an alternative embodiment, workpiece 202 may be a partially assembled workpiece with subparts wherein one or more stages may be used to conform various subparts to respective workpiece dimensional specifications.

Figure 4:
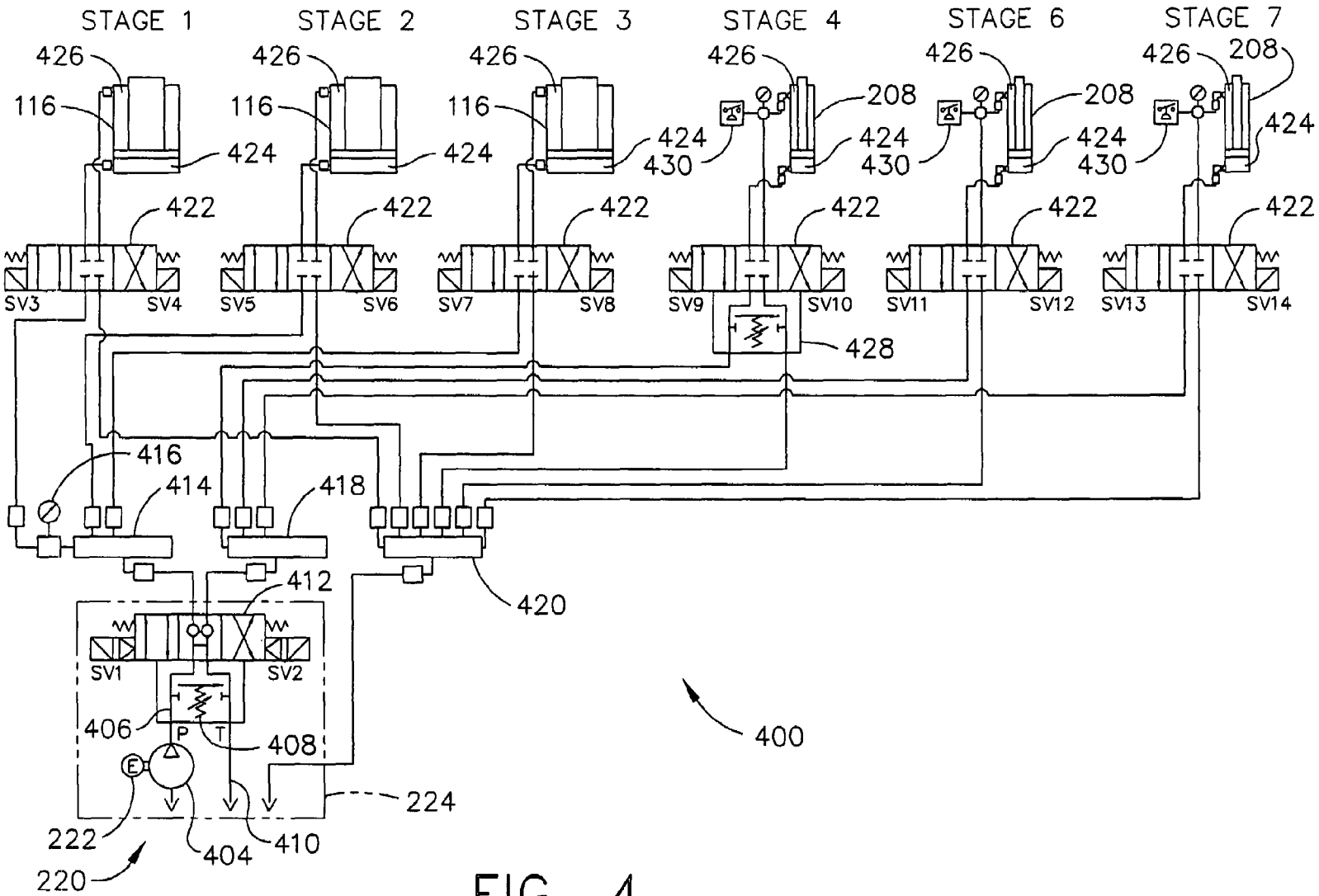
FIG. 4 is a schematic diagram of an exemplary hydraulic power unit and a hydraulic fluid under pressure system that may be used with the apparatus shown in FIGS. 1, 2, and 3.

FIG. 4 is a schematic diagram of an exemplary hydraulic power unit 220 (shown in FIG. 2) and a hydraulic fluid under pressure system 400 that may be used with apparatus 100 (shown in FIGS. 1, 2, and 3). In the exemplary embodiment, hydraulic power unit 220 includes a reservoir 224 for containing a predetermined quantity of working hydraulic fluid, a hydraulic fluid pump 404 driven by an electric motor 222. Hydraulic fluid pump 404 supplies hydraulic fluid under pressure to system 400 via a discharge line 406. A relief valve 408 directs at least a portion of the hydraulic fluid in line 406 to reservoir 224 through return line 410 when the hydraulic fluid pressure in line 406 exceeds a predetermined setpoint. Hydraulic fluid in discharge line 406 is directed into system 400 through a discharge valve 412, such as a four-way, three position solenoid valve, commercially available from Enerpac, Inc., of Milwaukee, Wis. In a first, centered position, valve 412 is closed such that no hydraulic fluid may pass through valve 412. In a second position, valve 412 is configured to direct hydraulic fluid to die fixture actuators 116 though a die fixture manifold 414. A pressure gage 416 located proximate die fixture manifold 414 permits monitoring of hydraulic fluid pressure to die fixture actuators 116. In a third position, valve 412 is configured to direct hydraulic fluid to holding member actuators 208 through a holding member actuator manifold 418. Hydraulic fluid from die fixture actuators 116 and holding member actuators 208 is returned to reservoir 224 through return manifold 420. In the exemplary embodiment, each of die fixture actuators 116 and holding member actuators 208 are controlled by a respective valve 422, which may be, for example, a remote mount four-way, three position solenoid valve, Cat. No. VEB-1500-B, commercially available from Enerpac, Inc., of Milwaukee, Wis. In a first, centered position, each of valves 422 are closed such that no hydraulic fluid may pass through valve 422. In a second position, each of valves 422 are configured to direct hydraulic fluid to an extend cavity 424 of an associated actuator 116, 208. In a third position, each of valves 422 is configured to direct hydraulic fluid to a retract cavity 426 of an associated actuator 116, 208. A pressure relief valve 428 may be coupled in flow communication with holding member actuator manifold 418 to return at least a portion of the hydraulic fluid from holding member actuator manifold 418 when the hydraulic fluid pressure in holding member actuator manifold 418 exceeds a predetermined setpoint. In the exemplary embodiment, each of holding member actuators 208 include a pressure switch 430 in flow communication with a respective retract cavity 426. Each pressure switch 430 provides an output signal relative to the hydraulic fluid pressure within a respective retract cavity 426. Operation of apparatus 100 may be controlled by controlling the position of valves 412 and valves 422. In the exemplary embodiment, valves 412 and valves 422 are solenoid actuated valves that may be controlled through a manual or automatic control system (not shown in FIG. 4).

Figure 5:
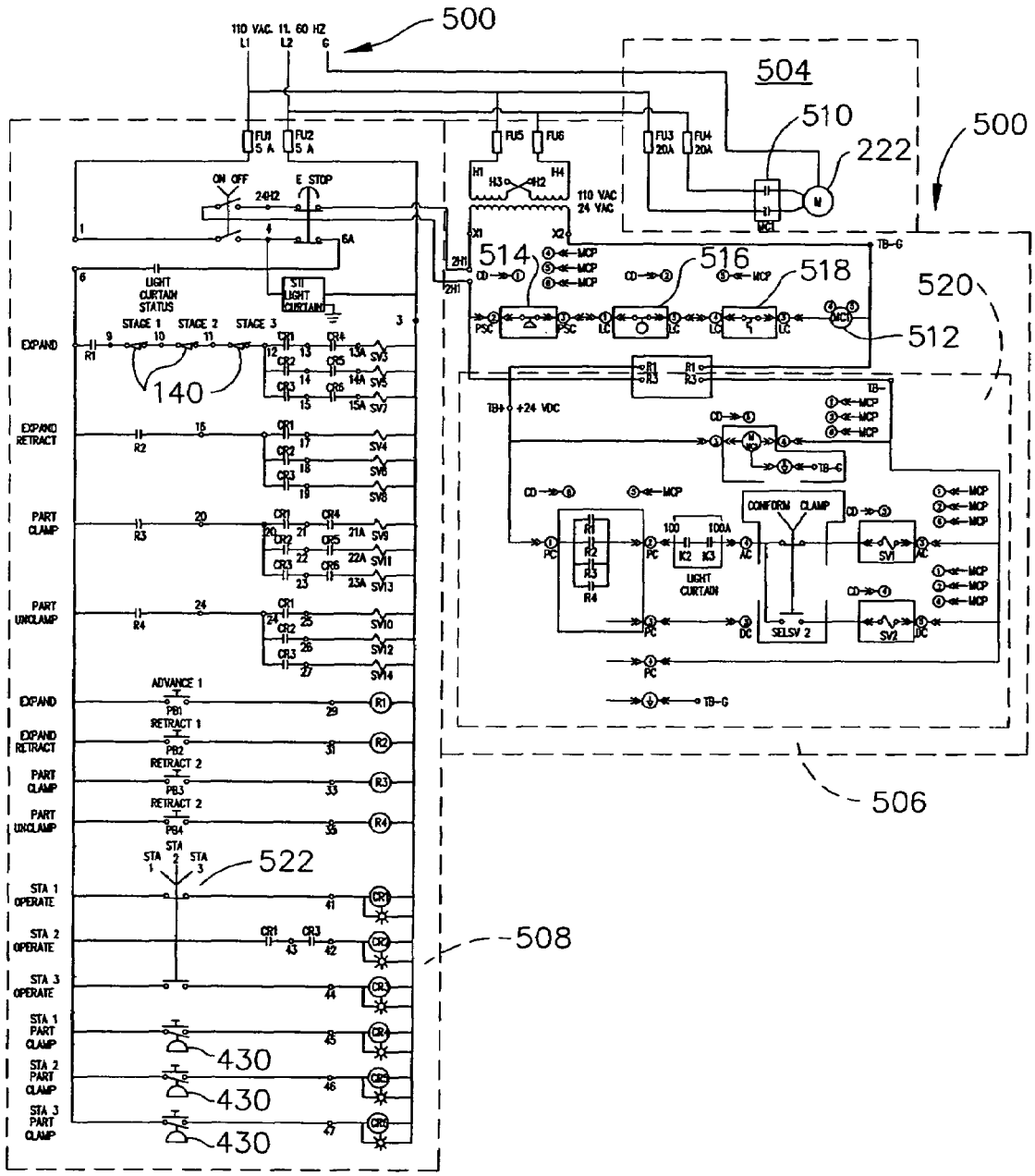
FIG. 5 is a schematic diagram of an exemplary electrical control system that may be used to control the apparatus shown in FIGS. 1, 2, and 3.

FIG. 5 is a schematic diagram of an exemplary electrical control system 500 that may be used to control apparatus 100 (shown in FIGS. 1, 2, and 3). In the exemplary embodiment, electrical control system 500 includes an electrical source 502 to a supply hydraulic pump motor circuit 504, a motor control circuit 506 and a apparatus control circuit 508. Hydraulic pump motor circuit 504 couples hydraulic pump motor 222 to electrical source 502 through motor main contacts 510.

Motor control circuit 506 includes a plurality of motor safety interlocks, such as, for example a pressure switch 514, a reservoir high level switch 516 and a reservoir low level switch 518, which deenergize a motor main contactor coil 512 to open main contacts 510 to facilitate protecting hydraulic pump 404 (shown in FIG. 4) and hydraulic pump motor 222. Motor control circuit 506 includes a direct current (DC) circuit portion 520, which controls a solenoid SV1 and a solenoid SV2 that determine a position of valve 512. Apparatus control circuit 508 includes control logic that controls the operation of a plurality of solenoids SV3–SV14 that are configured in pairs to operate each of die fixture actuators 116 and holding member actuators 208. Solenoids SV3–SV14 are controlled by a combination of relays R1–R4 and control relays CR1–CR6. Pushbuttons PB1–PB4 control electrical power flow to relays R1–R4 respectively in response to a user's manipulation. Control relays CR1–CR3 are energized in response to a position of a selector switch 522 to select which stage of apparatus 100 will be active. Control relays CR4–CR6 are energized in response to pressure switch 430 for each respective stage. When the pressure in retract cavity 426 of the respective holding member actuator 208 exceeds a predetermined setpoint, the respective pressure switch 430 activates to energize the associated control relay CR4–CR6, which closes the respective holding member actuator 208 supply valve 208 and permits operation of the respective die fixture actuators 116 in the retract direction. This interlock between holding member actuator 208 pressure and the operation of die fixture actuators 116 facilitates preventing applying a conforming force to workpiece 202 unless workpiece 202 is sufficiently held in place on die fixture 114 so that workpiece 202 cannot be ejected from apparatus 100 during the conforming operation. Additional personnel protection is afforded by an interlock 524, such as a light curtain, which detects the presence of personnel in a predetermined area and acts to stop movement of actuators 116 and 208.

Figure 6:
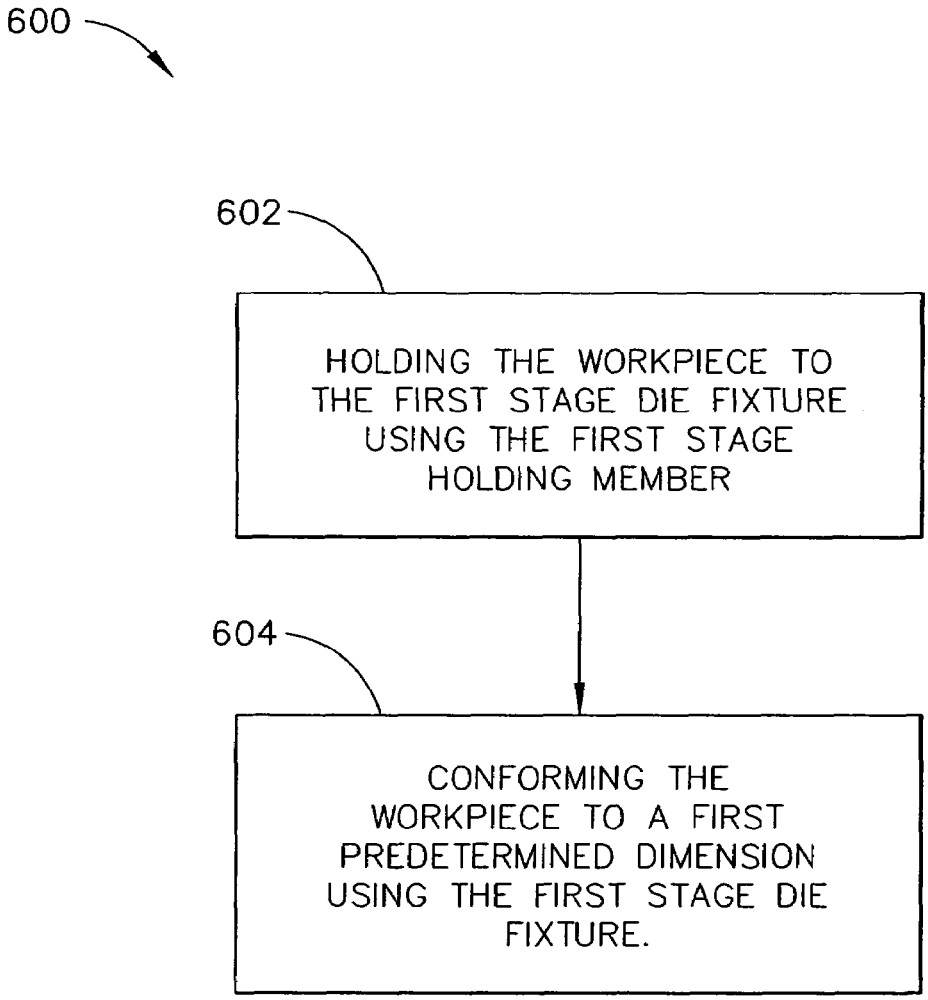
FIG. 6 is a flow diagram of an exemplary method that may be used to form a workpiece.

FIG. 6 is a flow diagram of an exemplary method 600 that may be used to form a workpiece using an apparatus that includes at least a first stage. The first stage may include a die fixture, a die actuator coupled to the die fixture, and a holding member configured to cooperate with the die fixture to hold the workpiece. Method 600 includes holding 602 the workpiece to the first stage die fixture using the first stage holding member, and conforming 604 the workpiece to a first predetermined dimension using the first stage die fixture.

In the exemplary embodiment, the first stage of the apparatus includes holding member configured to apply a holding bias to the workpiece during the conforming process. The workpiece is located proximate the first stage such that a first end is position proximate a holding member top cover and a second end is positioned proximate the die fixture. The top cover is aligned to engage the first end of the workpiece, and the second end of the workpiece is aligned to engage the die fixture. The holding member actuator is actuated to retract the actuator shaft such that the top cover applies a force to the workpiece that places a holding bias onto the workpiece. When the workpiece is in the "held" position, hydraulic fluid pressure in the retract cavity of the holding member actuator builds to a predetermined pressure wherein a pressure switch activates to deenergize the hydraulic fluid valve supplying the retract cavity of the holding member actuator to hydraulically lock the actuator in place. The predetermined pressure ensures sufficient holding force acting on the workpiece to facilitate preventing the workpiece from dislodging form the apparatus and becoming a projectile hazard during the conforming process. The activation of the pressure switch also permits the die fixture actuator to actuate to retract the die fixture centerpiece, which in turn forces the other die members to expand to predetermined dimensions to conform the workpiece predetermined dimensions.

When the die fixture actuator reaches a travel distance that corresponds to the die members reaching the predetermined dimensions, a travel limit switch trips to disable further die fixture actuator retraction. The die fixture may then be extended to release the force expanding the die members. A spring return or other bias device may be used to return the die members to their starting position. The holding member actuator may then be extended to release the holding force holding the workpiece to the die fixture and the workpiece removed from the apparatus or moved to another stage or the apparatus. The apparatus may include a plurality of stages, such that, a workpiece may be sequentially conformed to any number of desired dimensional specifications.

In the exemplary embodiment, the die fixture includes a plurality of die fixture members, such as, but, not limited to an expander centerpiece, an expander wedge, an expander end, a stripper, a spring return, and an expander bottom. Each die fixture member may be fabricated to dimensional specifications that complement the predetermined dimensional specification requirements of the workpiece. For example, dimensions of the expander centerpiece, the expander wedge, the expander end, and the expander bottom may be fabricated such that during the forming process, when the die fixture is expanded by the die actuator, the dimensions between an outer periphery of the die fixture members expand to the predetermined dimensional specifications that may be found in, for example, engineering drawings.

The above-described apparatus is cost-effective and highly reliable for conforming a workpiece to predetermined dimensional specifications during manufacturing and/or maintenance. Specifically, the apparatus holds a workpiece in relation to a die fixture that applies a conforming force to the workpiece. When the workpiece dimension attains a predetermined dimensional specification the apparatus stops applying the conforming force automatically. The apparatus is configured to conform newly fabricated blanks as well as repair finished workpieces returned from service for refurbishment. As a result, the apparatus facilitates reducing manufacturing and maintenance costs in a cost-effective and reliable manner.

Exemplary embodiments of apparatus assemblies are described above in detail. The apparatus assemblies are not limited to the specific embodiments described herein, but rather, components of each assembly may be utilized independently and separately from other components described herein. Each apparatus assembly component can also be used in combination with other apparatus assembly components.

While the invention has been described in terms of various specific embodiments, those skilled in the art will recognize that the invention can be practiced with modification within the spirit and scope of the claims.

What is claimed is:

1. A method of forming a workpiece using an apparatus that includes a first stage including a die fixture, a die actuator coupled to the die fixture, and a holding member configured to cooperate with the die fixture to hold the workpiece, said method comprising:

holding the workpiece to the first stage die fixture using the first stage holding member that includes an actuator to provide a holding force to substantially prevent the die fixture from moving when the actuator provides a holding force that is less than a predetermined holding force and applies the holding force to the first stage holding member such that a second end of the workpiece engages the die fixture; and moving a die member of the first stage die fixture radially outwardly against a bias to conform the workpiece to a first predetermined dimension using the first stage die fixture.

2. A method in accordance with claim 1 wherein holding the workpiece to the first stage die fixture using the first stage holding member comprises positioning the workpiece proximate the die fixture.

3. A method in accordance with claim 1 wherein holding the workpiece to the first stage die fixture using the first stage holding member comprises aligning a first end of the workpiece relative to the holding member.

4. A method in accordance with claim 1 wherein holding the workpiece to the first stage die fixture using the first stage holding member comprises aligning a second end of the workpiece relative to the die fixture.

5. A method in accordance with claim 1 wherein moving a die member of the first stage die fixture radially outwardly against a bias to conform the workpiece to a first predetermined dimension using the first stage die fixture comprises actuating the die actuator such that the first stage die fixture conforms the workpiece to a first predetermined dimension.

6. A method in accordance with claim 1 wherein the apparatus further includes a plurality of stages, said method comprising:

holding the workpiece to at least one other of the plurality of stages; and conforming the workpiece to a second predetermined dimension using at least one other of the plurality of stages.

7. A method in accordance with claim 1 wherein the workpiece further includes a mating piece coupled to a second end of the workpiece and wherein moving a die member of the first stage die fixture radially outwardly against a bias to conform the workpiece to a first predetermined dimension using the die fixture comprises conforming at least one of the mating piece and the workpiece to a first predetermined dimension.

8. A method in accordance with claim 1 wherein the workpiece is a gas turbine engine transition piece, the second end of the transition piece corresponding to the aft end relative to an installed configuration in the gas turbine engine, the method further comprising conforming the transition piece aft end to a first predetermined dimension using the first stage die fixture.

9. A method of forming a gas turbine engine transition piece using an aft end expander that includes at least a first stage including a die fixture, a die actuator coupled to the die fixture, and a holding member configured to cooperate with the die fixture to hold the workpiece during the forming process, said method comprising:

holding the transition piece to the at least first stage die fixture using the at least first stage holding member;

preventing the die fixture from moving when the actuator provides a holding force that is less than a predetermined holding force; and conforming the transition piece aft end to a first predetermined dimension using the at least first stage die fixture.

10. An apparatus for forming a workpiece, said apparatus includes a first stage comprising:

a die fixture comprising an expander wedge and an expander centerpiece, said expander wedge configured to engage said expander centerpiece and configured to engage the workpiece, said expander wedge biased from an expanded position to a contracted position;

a die actuator coupled to said die fixture and coupled to said expander centerpiece; and a holding member configured to cooperate with the die fixture to hold the workpiece, said holding member comprising a top holder configured to engage a first end of the workpiece, a vertical slide coupled to an apparatus base, said vertical slide extending away from said base, and a slide clamp slidably coupled to said vertical slide, said top holder is pivotally coupled to said slide clamp.

11. An apparatus in accordance with claim 10 wherein said expander centerpiece comprises a force surface configured to slidily engage said expander wedge for transmitting a force imparted to said expander centerpiece to said expander wedge.

12. An apparatus in accordance with claim 11 wherein said expander wedge has a substantially wedged-shaped cross-sectional profile.

13. An apparatus in accordance with claim 11 wherein said expander wedge is configured to move perpendicular to a movement of said expander centerpiece.

14. An apparatus in accordance with claim 10 wherein said die actuator comprises a ram comprising a shaft.

15. An apparatus in accordance with claim 14 wherein said ram comprises a hydraulic cylinder.

16. An apparatus in accordance with claim 14 wherein said ram comprises a double-acting hydraulic cylinder.

17. An apparatus in accordance with claim 10 wherein said holding member further comprises a holding member actuator coupled to said slide clamp.

18. An apparatus in accordance with claim 17 wherein said holding member actuator comprises a ram comprising a shaft.

19. An apparatus in accordance with claim 18 wherein said ram comprises a hydraulic cylinder.

20. An apparatus in accordance with claim 18 wherein said ram comprises a double-acting hydraulic cylinder.

21. An apparatus in accordance with claim 10 comprising a plurality of stages.

22. An apparatus in accordance with claim 21 wherein each of the plurality of stages is configured to conform the workpiece to a different predetermined dimension than each other stage.

23. An apparatus in accordance with claim 10 further comprising a source of hydraulic fluid under pressure.

24. An apparatus in accordance with claim 23 wherein said source of hydraulic fluid under pressure is operatively coupled in flow communication with at least one of said die actuator and a holding member actuator.

25. An apparatus in accordance with claim 23 wherein said source of hydraulic fluid under pressure is operatively coupled a hydraulic power circuit coupled to the at least one of said die actuator and a holding member actuator through an actuator valve.

26. An apparatus in accordance with claim 10 further comprising an interlock configured to prevent motion of said die fixture when a holding member actuator hydraulic fluid pressure is less than a predetermined pressure.

27. An apparatus in accordance with claim 10 further comprising an interlock configured to detect a user proximity to said apparatus, said interlock further configured to stop motion of said die actuator and a holding member actuator when the user proximity is detected.

28. An apparatus in accordance with claim 10 further comprising a limit switch configured to stop motion of said die actuator when said die actuator reaches a predetermined travel limit.

* * * * *